US007175358B1

(12) United States Patent
Revivo

(10) Patent No.: US 7,175,358 B1
(45) Date of Patent: Feb. 13, 2007

(54) COSMETIC APPLICATOR

(75) Inventor: Jacob Revivo, Sherman Oaks, CA (US)

(73) Assignee: Spa de Soleil, Inc., Sun Valley, CA (US)

( * ) Notice: Subject to any disclaimer, the term of this patent is extended or adjusted under 35 U.S.C. 154(b) by 0 days.

(21) Appl. No.: 11/215,112

(22) Filed: Aug. 29, 2005

(51) Int. Cl.
*A45D 40/20* (2006.01)

(52) U.S. Cl. ..... 401/88; 401/87; 401/55; 401/68; 401/70; 401/75

(58) Field of Classification Search ..... 401/49, 401/55, 62, 64–72, 75, 78, 87, 88
See application file for complete search history.

(56) References Cited

U.S. PATENT DOCUMENTS

| | | | | |
|---|---|---|---|---|
| 6,071,027 | A * | 6/2000 | Gueret | 401/75 |
| 6,200,047 | B1 * | 3/2001 | Holloway | 401/75 |
| 6,231,254 | B1 * | 5/2001 | Holloway | 401/88 |
| 6,340,258 | B2 * | 1/2002 | Gueret | 401/87 |
| 6,371,673 | B1 * | 4/2002 | Gueret | 401/75 |
| 6,905,272 | B2 * | 6/2005 | Yamanaka | 401/75 |
| 2001/0003564 | A1 * | 6/2001 | Gueret | 401/68 |
| 2005/0163554 | A1 * | 7/2005 | Cara Sanchez | 401/75 |

* cited by examiner

*Primary Examiner*—Khoa D. Huynh
(74) *Attorney, Agent, or Firm*—Thomas I. Rozsa

(57) ABSTRACT

The present invention is an improved cosmetic applicator which contains a new and novel apparatus to expose and retract a cosmetic stick contained within the applicator apparatus. The apparatus comprises an internal threaded shaft supported on a base which includes rotation means such as a knob, the shaft having a multiplicity of spaced apart threads on its exterior surface. A hollow cylindrical shelf having means at one end to support a cosmetic and a pair of interior oppositely disposed male teeth adjacent its opposite end which interact with the threads enables the shelf to ride up and down on the threaded shaft as the knob is turned to thereby expose and retract the cosmetic supported at the upper end of the cylindrical shelf. A hollow exterior cylindrical casing is supported at one end within the base and surrounds the hollow cylindrical self and the cosmetic supported thereon. The cylindrical casing is covered by an exterior cylindrical casing when the apparatus is not in use.

14 Claims, 3 Drawing Sheets

COSMETIC APPLICATOR

BACKGROUND OF THE INVENTION

1. Field of the Invention

The present invention relates to the field of cosmetic applicators and more particularly to applicators which are used to expose portions of cosmetics such as lipstick, soaps, and cosmetics which are contained in a stick form and which are applied to a body part such as the face through the applicator.

2. Description of the Prior Art

In general, cosmetic applicators such as lipstick dispensers are known in the prior art. However, they all work on the principle of having and interior casing with internal threads which ride on interior threads of an external casing to expose the cosmetic product such as lipstick. There is a significant need for an improved cosmetic applicator which functions in a more efficient way to expose and retract the cosmetics such as lipstick contained within the applicator.

SUMMARY OF THE INVENTION

The present invention is an improved cosmetic applicator which contains a new and novel apparatus to expose and retract a cosmetic stick contained within the applicator apparatus. The apparatus comprises an internal threaded shaft supported on a base which includes rotation means such as a knob, the shaft having a multiplicity of spaced apart threads on its exterior surface. A hollow cylindrical shelf having means at one end to support a cosmetic and a pair of interior oppositely disposed male teeth adjacent its opposite end which interact with the threads enables the shelf to ride up and down on the threaded shaft as the knob is turned to thereby expose and retract the cosmetic supported at the upper end of the cylindrical shelf. A hollow exterior cylindrical casing is supported at one end within the base and surrounds the hollow cylindrical shelf and the cosmetic supported thereon. The cylindrical casing is covered by an exterior cylindrical casing when the apparatus is not in use.

It has been discovered, according to the present invention, that an improved cosmetic applicator can be achieved by having the apparatus which exposes and retracts the cosmetic; created from an internal cylindrical shaft having a rotation means such as a knob at one end and further having a multiplicity of spaced apart threads on its exterior surface which threads interact with a pair of oppositely disposed male teeth adjacent one end of an interior shelf which causes the shelf to move up and down as the threaded shaft is caused to rotate by turning the knob at one end of the shaft.

It has further been discovered, according to the present invention, that if a hollow cylinder surrounds the internal shelf and the internal shelf which interacts with the threaded shaft also comprises a means to support a cosmetic adjacent its end opposite from the internal teeth, then as the internal shelf rides up and down on the threaded shaft as the threaded shaft is rotated, then the cosmetic will be exposed when the knob is turned in one direction as the teeth ride up on the threads and the cosmetic will be retracted when the knob is turned in the opposite direction as the teeth ride down on the threads.

It has also been discovered, according to the present invention, that by having the assembly of an internal threaded shaft interacting with teeth on an internal cylindrical shelf which supports a cosmetic, the assembly eliminates the need to have the casing which supports the cosmetic interact with and ride on and within the exterior casing which encloses the cosmetic.

It is therefore an object of the present invention to provide an improved cosmetic applicator by having the apparatus which exposes and retracts the cosmetic created from an internal cylindrical shaft having a rotation means such as a knob at one end and further having a multiplicity of spaced apart threads on its exterior surface which threads interact with a pair of oppositely disposed male teeth adjacent one end of an interior shelf which causes the shelf to move up and down as the threaded shaft is caused to rotate by turning the knob at one end of the shaft.

It is a further object of the present invention to provide an internal shelf having internal teeth at one end which interact with the threads of threaded shaft and also comprises a means to support a cosmetic adjacent its end opposite from the internal teeth, and to further provide a hollow cylinder which surrounds the internal shelf and cosmetic supported thereon, so that as the internal shelf rides up and down on the threaded shaft as the threaded shaft is rotated, then the cosmetic will be exposed when the knob is turned in one direction as the teeth ride up on the threads and the cosmetic will be retracted when the knob is turned in the opposite direction as the teeth ride down on the threads.

It is another object of the present invention to provide an assembly of an internal threaded shaft interacting with teeth on an internal cylindrical shelf which supports a cosmetic, to thereby eliminate the need to have the casing which supports the cosmetic interact with and ride on and within the exterior casing which encloses the cosmetic.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
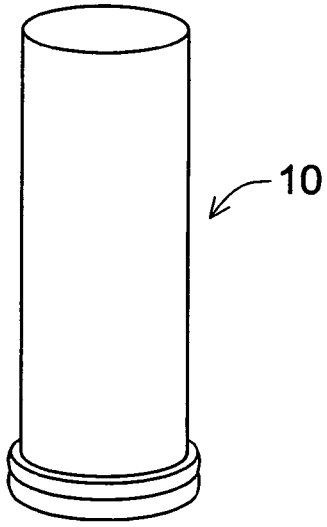
FIG. 1 is a perspective view of the present invention cosmetic applicator in the closed condition with the exterior cylindrical cover surrounding the interior cylindrical casing.
Figure 2:
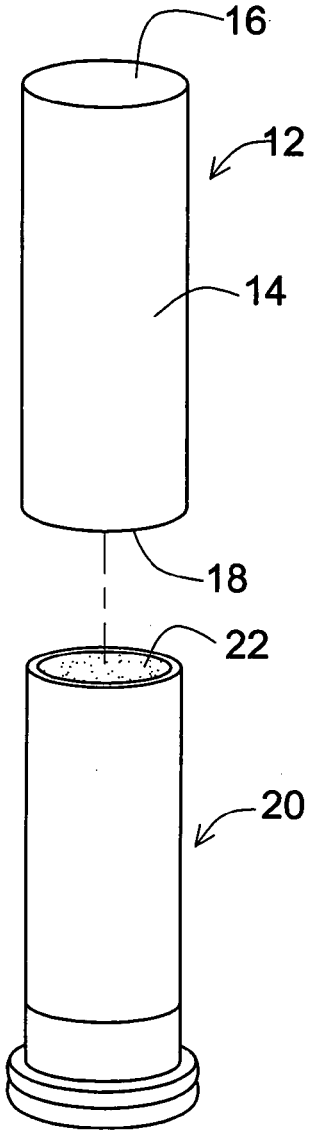
FIG. 2 is an exploded perspective view of the present invention cosmetic applicator in the opened condition with the exterior cylindrical cover removed from the interior cylindrical casing.
Figure 3:
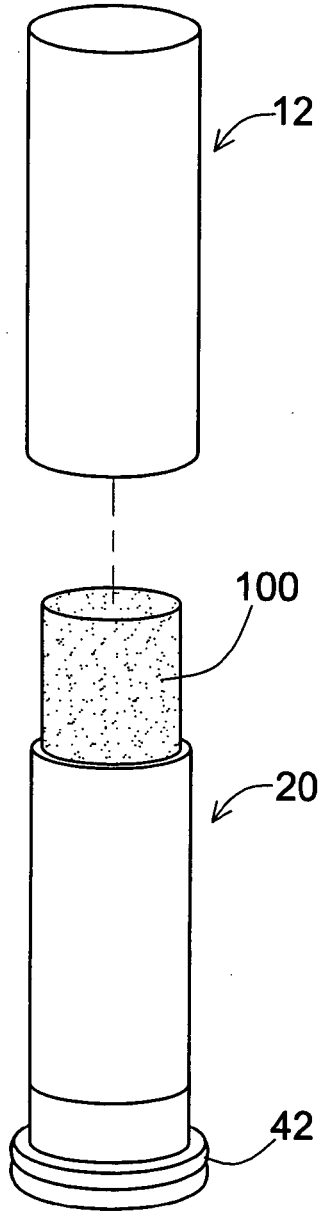
FIG. 3 is an exploded perspective view of the present invention cosmetic applicator in the opened and in use condition with the exterior cylindrical cover removed from the interior cylindrical casing and the cosmetic exposed from the interior cylindrical casing.
Figure 5:
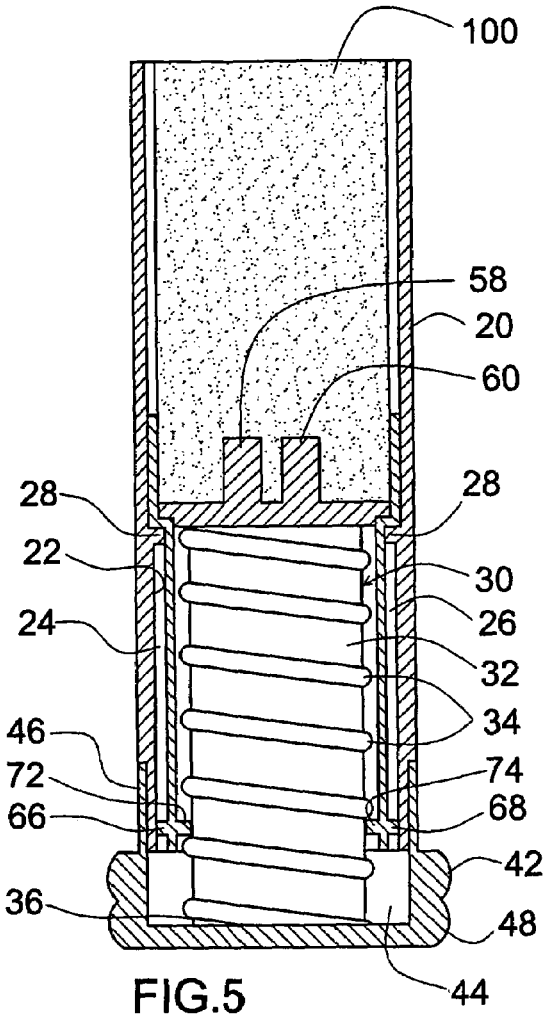
FIG. 5 is an internal cross-sectional view of the entire operating assembly of the present invention cosmetic applicator showing the internal shelf and the cosmetic in the retracted condition.
Figure 6:
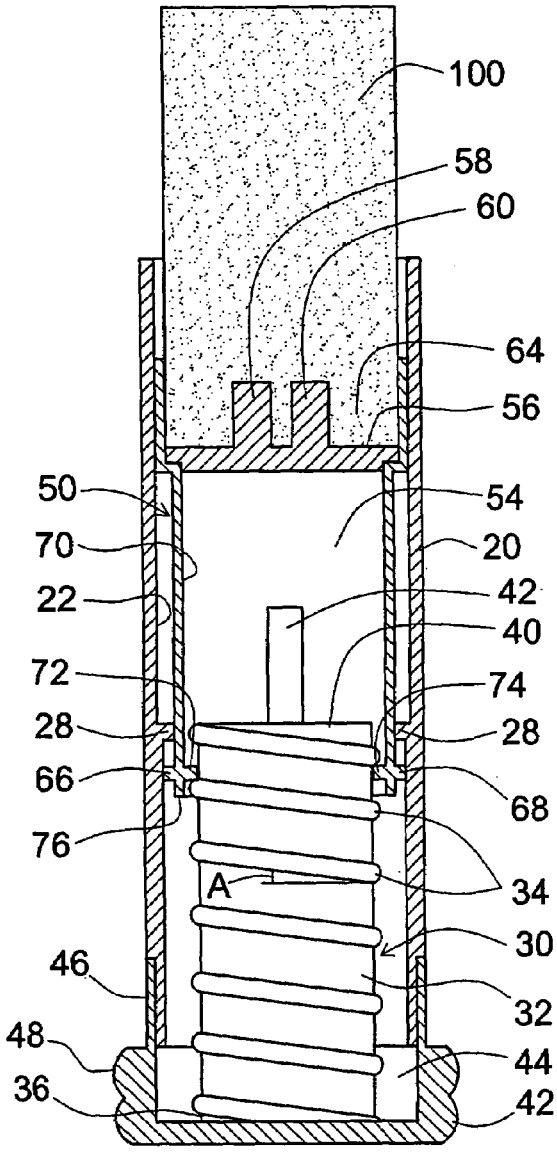
FIG. 6 is an internal cross-sectional view of the entire operating assembly of the present invention cosmetic applicator showing the internal shelf and the cosmetic in the fully extended condition.

Referring to FIGS. 1 and 2 there is illustrated at 10 the present invention cosmetic applicator which comprises an exterior hollow cylindrical cover 12 having a cylindrical wall 14 and top 16 and an internal cavity surrounded by cylindrical wall 14 and closed at the top 16 and open at the bottom 18. The cosmetic applicator 10 further comprises an internal cylindrical casing 20. Referring to FIGS. 5 and 6, the internal cylindrical casing 20 has an internal wall 22 having a pair of oppositely disposed internal longitudinal channels 24 ad 26 which as illustrated in FIG. 5 extend along the lower portion internal cylindrical casing 20. The longitudinal channels 24 and 26 terminate at an interior transverse channel wall 28.

Figure 4:
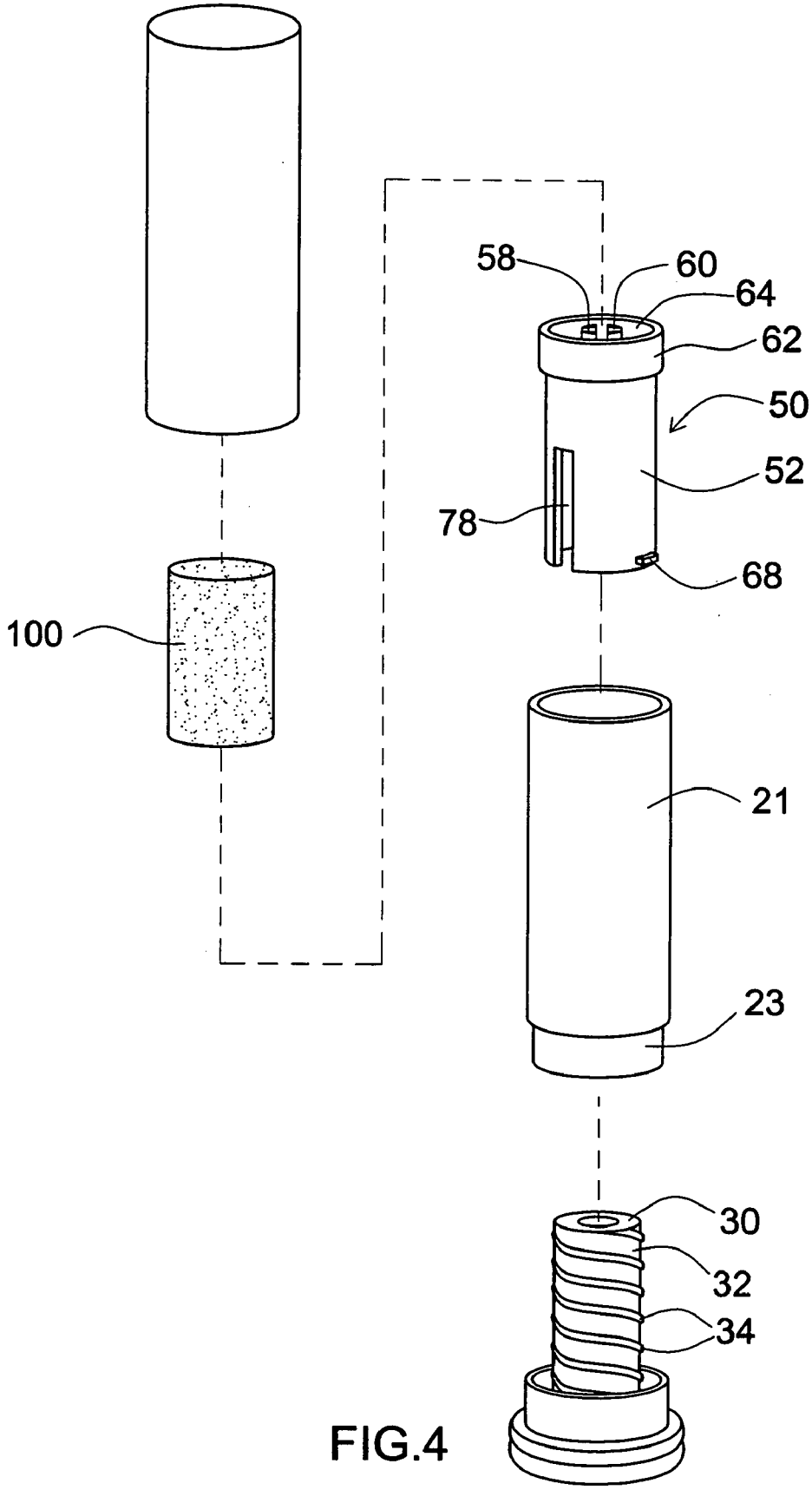
FIG. 4 is an exploded view of the entire operating assembly of the present invention cosmetic applicator.

Referring to FIGS. 4, 5 and 6 there is illustrated the new and novel operating mechanism of the present invention cosmetic applicator 10. The first portion of the operating mechanism is a cylindrical shaft 30 which has an exterior cylindrical wall 32 onto which are formed a multiplicity of spaced apart threads 34. The cylindrical shaft 30 has a bottom 36 and a top 38 onto which is formed a post 40. The cylindrical shaft 30 is supported at its bottom 36 in a base 42 having an interior cavity 44 and an exterior cylindrical wall 46 having grasping means such as knobs 48 adjacent its lower end. The internal cylindrical casing 20 has an exterior wall 21 with a recessed area 23. As illustrated in FIGS. 5 and 6, the recessed area 23 of exterior wall 21 of casing 20 fits into the interior cavity 44 of base 42 and is retained therein. The next component of the operating mechanism is a hollow cylindrical shelf 50 having a exterior wall 52 which surrounds a hollow interior cavity 54. At the top of the hollow cylindrical shelf 50 is a top platform 56 having a pair of cosmetic grasping and retaining means such as posts 58 and 60 and a top circumferential wall 62 which forms a top cavity 64 surrounded by the top circumferential wall 62 and the platform 56. The lower portion of a cosmetic 100 is retained within the top cavity 64 and is supported on posts 58 and 60 onto which a cosmetic 100 is retained. The exterior wall 52 of hollow cylindrical shelf 50 has formed thereon a pair of oppositely disposed aligned exterior shelf teeth 66 and 68 which respectively are positioned within longitudinal channel 24 and 26 of internal wall 22 of interior cylindrical casing 20 to prevent the hollow cylindrical shelf 50 from rotating within internal cylindrical casing 20. Hollow cylindrical shelf 50 has formed on interior surface 70 of wall 52 two oppositely disposed aligned interior shelf teeth 72 and 74 adjacent the bottom 76 of hollow cylindrical shelf 50. As on option, tooth 72 can be aligned with tooth 66 and tooth 74 can be aligned with tooth 68 but this is not required. Interior shelf teeth 72 and 74 are positioned to be received within the space between adjacent threads 34 of cylindrical shaft 30. As an option, exterior wall 52 of hollow cylindrical shelf 50 has a pair of oppositely disposed slots, of which one 78 is illustrated. This provides flexibility to the hollow cylindrical shelf 50 as it rides on the threads 34 of cylindrical shaft 30.

The operating assembly is positioned together so that cylindrical shaft 30 is positioned within hollow interior cavity 54 of hollow cylindrical shelf 50 so that the threads 34 of the cylindrical shaft 30 intermesh with oppositely disposed interior teeth 72 and 74 of hollow cylindrical shelf 50. As knob 48 of base 42 is rotated, the teeth 72 and 74 ride on the threads 34. When rotated in one direction such as counterclockwise, the teeth 72 and 74 rotate downwardly on the threads 34 and cause the hollow cylindrical shelf 50 to move upwardly within internal cylindrical casing 20 to expose the cosmetic 100 as illustrated in FIG. 6. When the knob 48 is rotated in the opposite direction such as clockwise, the teeth 72 and 74 ride downwardly on threads 34 and cause the hollow cylindrical shelf 50 to move downwardly within interior cylindrical casing 20 so that the cosmetic 100 is retracted as illustrated in FIG. 5. The exterior teeth 66 and 68 within channels 24 and 26 prevent the hollow cylindrical shelf 50 from rotating or spinning so it will only move up and down within interior cylindrical casing 20. To facilitate the up and down movement, the threads 34 are at an angle "A" to the horizontal which by way of example only can be fifteen (15) degrees. Any other angle "A" is within the spirit and scope of the present invention.

While the embodiment as described is the preferred embodiment, it will be appreciated that the operating mechanism of the present invention can work with at least one interior tooth 72 or 74 and at least one exterior tooth 66 or 68.

The entire mechanism of the operating assembly including the cylindrical shaft 30 and its components can be molded out of plastic. Similarly, the hollow cylindrical shelf 50 and its components can be molded out of plastic.

The present invention cosmetic applicator 10 can be used with any cosmetic 100 such as lipstick, a soap stick, rouge, mascara or any other cosmetic that is applied to any body part such as the face, hands, feet, etc.

Defined in detail, the present invention is a cosmetic applicator, comprising: (a) an internal cylindrical casing having an exterior wall having a top and a bottom with a recess in the exterior wall adjacent the location of the bottom, the exterior wall having an interior surface defining an interior chamber, the interior surface having a pair of oppositely disposed longitudinal channels extending from adjacent the bottom of the casing to an area between the top and bottom of the casing and terminating at an interior transverse wall; (b) a cylindrical shaft having an exterior cylindrical wall with a multiplicity of spaced apart parallel threads formed at an angle on the exterior cylindrical wall, the cylindrical shaft having a top and a bottom, a base having an exterior wall and a bottom which form an interior cavity into which the bottom of the cylindrical shaft is affixed with a space in the interior cavity around the bottom of the cylindrical shaft, the base having grasping means on its exterior wall; (c) a hollow cylindrical shelf having an exterior wall with a top and bottom, the top of the exterior wall terminating in a top platform with a top circumferential wall extending from the top platform to form a top cavity with a pair of cosmetic grasping means formed on the top platform and extending into the top cavity, a pair of oppositely disposed teeth extending transversely from the exterior wall, the exterior wall having an interior surface defining an interior cavity which is open at the bottom and a pair of oppositely disposed interior teeth adjacent the bottom of the interior surface and extending transversely from the interior surface into the cavity; (d) the cylindrical shaft and the hollow cylindrical shelf received within the interior chamber of the internal cylindrical casing with the recess in the lower area of the exterior wall of the internal cylindrical casing retained within the hollow cavity of the base and surrounding the cylindrical shaft; and (e) the cylindrical shaft being positioned within the hollow interior cavity of the hollow cylindrical shelf so that the threads of the cylindrical shaft intermesh with the oppositely disposed interior teeth of the hollow cylindrical shelf so that as the grasping means causes the base to rotate, the interior teeth ride on the threads and when the cylindrical shaft is rotated in one direction the teeth rotate upwardly on the threads and cause the hollow cylindrical shelf to move upwardly within internal cylindrical casing and when the grasping means is rotated in the opposite direction the teeth ride downwardly on threads and cause the hollow cylindrical shelf to move downwardly within interior cylindrical casing, each respective exterior tooth on the hollow cylindrical shelf respectively received within a longitudinal channel in the interior wall of the internal cylindrical casing to prevent the hollow cylindrical shelf from rotating or spinning so it will only move up and down within interior cylindrical casing.

Defined broadly, the present invention is a cosmetic applicator, comprising: (a) a generally cylindrical casing having an exterior wall having a top and a bottom and having retaining means on the exterior wall, the exterior wall having an interior surface defining an interior chamber, the interior surface having a pair of oppositely disposed longitudinal channels extending from adjacent the bottom of the casing to an area between the top and bottom of the casing and terminating at an interior transverse wall; (b) a cylindrical shaft having an exterior cylindrical wall with a multiplicity of spaced apart parallel threads formed at an angle on the exterior cylindrical wall, the shaft supported on a base having grasping means; (c) a hollow cylindrical shelf having an exterior wall with a top and bottom, the top of the exterior wall terminating in a top platform having means to retain a cosmetic, a pair of oppositely disposed teeth extending transversely from the exterior wall, the exterior wall having an interior surface defining an interior cavity which is open at the bottom and a pair of oppositely disposed interior teeth adjacent the bottom of the interior surface and extending transversely from the interior surface into the cavity; (d) the retaining means of the internal cylindrical casing engaging a portion of the base of the cylindrical shaft and retained by the base, the cylindrical shaft and the hollow cylindrical shelf received within the internal chamber of the generally cylindrical casing; and (e) the cylindrical shaft being positioned within the hollow interior cavity of the hollow cylindrical shelf so that the threads of the cylindrical shaft intermesh with the oppositely disposed interior teeth of the hollow cylindrical shelf so that as the grasping means causes the base to rotate, the interior teeth ride on the threads and when the cylindrical shaft is rotated in one direction the teeth rotate upwardly on the threads and cause the hollow cylindrical shelf to move upwardly within generally cylindrical casing and when the grasping means is rotated in the opposite direction the teeth ride downwardly on threads and cause the hollow cylindrical shelf to move downwardly within interior cylindrical casing, each respective exterior tooth on the hollow cylindrical shelf respectively received within a longitudinal channel in the interior wall of the internal cylindrical casing to prevent the hollow cylindrical shelf from rotating or spinning so it will only move up and down within interior cylindrical casing.

Defined more broadly, the present invention is a cosmetic applicator, comprising:

(a) a casing having an exterior wall having a top and a bottom and having retaining means, the exterior wall having an interior surface defining an interior chamber; (b) a shaft having an exterior wall with a multiplicity of spaced apart parallel threads formed at an angle on the exterior wall, the shaft supported on a base having grasping means thereon; (c) a hollow shelf having an exterior wall with a top and bottom, the hollow shelf having means to retain a cosmetic, a wall having an interior surface defining an interior cavity which is open at the bottom and a pair of oppositely disposed interior teeth adjacent the bottom of the interior surface and extending transversely from the interior surface into the cavity; (d) the retaining means of the casing retained by the base, the shaft and the hollow shelf received within the interior chamber of the casing; and (e) the shaft being positioned within the hollow interior cavity of the hollow shelf so that the threads of the shaft intermesh with the oppositely disposed interior teeth of the hollow shelf so that as the grasping means causes the base to rotate, the interior teeth ride on the threads and when the shaft is rotated in one direction the teeth rotate upwardly on the threads and cause the hollow shelf to move upwardly within the casing and when the grasping means is rotated in the opposite direction the teeth ride downwardly on threads and cause the hollow shelf to move downwardly within the casing.

Defined even more broadly, the present invention is a cosmetic applicator, comprising:

(a) a casing having an exterior wall having a top and a bottom and having retaining means, the exterior wall having an interior surface defining an interior chamber; (b) a shaft having an exterior wall with a multiplicity of spaced apart parallel threads formed at an angle on the exterior wall, the shaft supported on a base having grasping means thereon; (c) a hollow shelf having an exterior wall with a top and bottom, the hollow shelf having means to retain a cosmetic, a wall having an interior surface defining an interior cavity which is open at the bottom and at least one interior tooth disposed adjacent the bottom of the interior surface and extending transversely from the interior surface into the cavity; (d) the retaining means of the internal cylindrical casing retained by the base, the shaft and the hollow shelf received within the interior chamber of the casing; and (e) the shaft being positioned within the hollow interior cavity of the hollow shelf so that the threads of the shaft intermesh with the at least one interior tooth of the hollow shelf so that as the grasping means causes the base to rotate, the at least one interior tooth rides on the threads and when the shaft is rotated in one direction the at least one interior tooth rotates upwardly on the threads and cause the hollow shelf to move upwardly within the casing and when the grasping means is rotated in the opposite direction the at least one tooth rides downwardly on the threads and causes the hollow shelf to move downwardly within the casing.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A cosmetic applicator, comprising:

a. an internal cylindrical casing having an exterior wall having a top and a bottom with a recess in the exterior wall adjacent the location of the bottom, the exterior wall having an interior surface defining an interior chamber, the interior surface having a pair of oppositely disposed longitudinal channels extending from adjacent the bottom of the casing to an area between the top and bottom of the casing and terminating at an interior transverse wall;

b. a cylindrical shaft having an exterior cylindrical wall with a multiplicity of spaced apart parallel threads formed at an angle on the exterior cylindrical wall, the cylindrical shaft having a top and a bottom, a base having an exterior wall and a bottom which form an interior cavity into which the bottom of the cylindrical shaft is affixed with a space in the interior cavity around the bottom of the cylindrical shaft, the base having grasping means on its exterior wall;

c. a hollow cylindrical shelf having an exterior wall with a top and bottom, the top of the exterior wall terminating in a top platform with a top circumferential wall extending from the top platform to form a top cavity with a pair of cosmetic grasping means formed on the top platform and extending into the top cavity, a pair of oppositely disposed teeth extending transversely from the exterior wall, the exterior wall having an interior surface defining an interior cavity which is open at the bottom and a pair of oppositely disposed interior teeth adjacent the bottom of the interior surface and extending transversely from the interior surface into the cavity;

d. the cylindrical shaft and the hollow cylindrical shelf received within the interior chamber of the internal cylindrical casing with the recess in the lower area of the exterior wall of the internal cylindrical casing retained within the hollow cavity of the base and surrounding the cylindrical shaft; and e. the cylindrical shaft being positioned within the hollow interior cavity of the hollow cylindrical shelf so that the threads of the cylindrical shaft intermesh with the oppositely disposed interior teeth of the hollow cylindrical shelf so that as the grasping means causes the base to rotate, the interior teeth ride on the threads and when the cylindrical shaft is rotated in one direction the teeth rotate upwardly on the threads and cause the hollow cylindrical shelf to move upwardly within internal cylindrical casing and when the grasping means is rotated in the opposite direction the teeth ride downwardly on threads and cause the hollow cylindrical shelf to move downwardly within interior cylindrical casing, each respective exterior tooth on the hollow cylindrical shelf respectively received within a longitudinal channel in the interior wall of the internal cylindrical casing to prevent the hollow cylindrical shelf from rotating or spinning so it only moves up and down within interior cylindrical casing.

2. The cosmetic applicator in accordance with claim 1 further comprising a cosmetic retained by the cosmetic grasping means on the hollow cylindrical shelf so that the cosmetic extends above the hollow cylindrical shelf within the internal cylindrical casing so that the cosmetic is exposed when the cylindrical shaft is rotated in one direction to cause the interior teeth to move upwardly on the threads of the cylindrical shaft and the cosmetic is retracted when the cylindrical shaft is rotated in the opposite direction to cause the interior teeth to move downwardly on the threads of the cylindrical shaft.

3. The cosmetic applicator in accordance with claim 1 further comprising a cylindrical cover having a cylindrical wall and a top and an open bottom defining an interior cavity, the cover placed over the internal cylindrical casing so that it rests within the internal cavity of the top cover when the cosmetic applicator is not in use.

4. The cosmetic applicator in accordance with claim 1 wherein the cosmetic grasping mean is further comprised of a pair of spaced apart posts.

5. The cosmetic applicator in accordance with claim 1 wherein the gasping mean on the base are knobs.

6. A cosmetic applicator, comprising:

a. a generally cylindrical casing having an exterior wall having a top and a bottom and having retaining means on the exterior wall, the exterior wall having an interior surface defining an interior chamber, the interior surface having a pair of oppositely disposed longitudinal channels extending from adjacent the bottom of the casing to an area between the top and bottom of the casing and terminating at an interior transverse wall;

b. a cylindrical shaft having an exterior cylindrical wall with a multiplicity of spaced apart parallel threads formed at an angle on the exterior cylindrical wall, the shaft supported on a base having grasping means;

c. a hollow cylindrical shelf having an exterior wall with a top and bottom, the top of the exterior wall terminating in a top platform having means to retain a cosmetic, a pair of oppositely disposed teeth extending transversely from the exterior wall, the exterior wall having an interior surface defining an interior cavity which is open at the bottom and a pair of oppositely disposed interior teeth adjacent the bottom of the interior surface and extending transversely from the interior surface into the cavity;

d. the retaining means of the internal cylindrical casing engaging a portion of the base of the cylindrical shaft and retained by the base, the cylindrical shaft and the hollow cylindrical shelf received within the internal chamber of the generally cylindrical casing; and e. the cylindrical shaft being positioned within the hollow interior cavity of the hollow cylindrical shelf so that the threads of the cylindrical shaft intermesh with the oppositely disposed interior teeth of the hollow cylindrical shelf so that as the grasping means causes the base to rotate, the interior teeth ride on the threads and when the cylindrical shaft is rotated in one direction the teeth rotate upwardly on the threads and cause the hollow cylindrical shelf to move upwardly within generally cylindrical casing and when the grasping means is rotated in the opposite direction the teeth ride downwardly on threads and cause the hollow cylindrical shelf to move downwardly within interior cylindrical casing, each respective exterior tooth on the hollow cylindrical shelf respectively received within a longitudinal channel in the interior wall of the internal cylindrical casing to prevent the hollow cylindrical shelf from rotating or spinning so it only moves up and down within interior cylindrical casing.

7. The cosmetic applicator in accordance with claim 6 further comprising a cosmetic retained by the means to retain a cosmetic on the hollow cylindrical shelf so that the cosmetic extends above the hollow cylindrical shelf within the internal cylindrical casing so that the cosmetic is exposed when the cylindrical shaft is rotated in one direction to cause the interior teeth to move upwardly on the threads of the cylindrical shaft and the cosmetic is retracted when the cylindrical shaft is rotated in the opposite direction to cause the interior teeth to move downwardly on the threads of the cylindrical shaft.

8. The cosmetic applicator in accordance with claim 6 further comprising a cylindrical cover having a cylindrical wall and a top and an open bottom defining an interior cavity, the cover placed over the internal cylindrical casing so that it rests within the internal cavity of the top cover when the cosmetic applicator is not in use.

9. The cosmetic applicator in accordance with claim 6 wherein the gasping mean on the base are knobs.

10. The cosmetic applicator in accordance with claim 6 wherein the generally cylindrical casing and its components, the cylindrical shaft and its components, and the hollow cylindrical shelf and its components are made of plastic.

11. A cosmetic applicator, comprising:

a. a casing having an exterior wall having a top and a bottom and having retaining means, the exterior wall having an interior surface defining an interior chamber;

b. a shaft having an exterior wall with a multiplicity of spaced apart parallel threads formed at an angle on the exterior wall, the shaft supported on a base having grasping means thereon;

c. a hollow shelf having an exterior wall with a top and bottom, the hollow shelf having means to retain a cosmetic, a wall having an interior surface defining an interior cavity which is open at the bottom and a pair of oppositely disposed interior teeth adjacent the bottom of the interior surface and extending transversely from the interior surface into the cavity;

d. the retaining means of the casing retained by the base, the shaft and the hollow shelf received within the interior chamber of the casing; and e. the shaft being positioned within the hollow interior cavity of the hollow shelf so that the threads of the shaft intermesh with the oppositely disposed interior teeth of the hollow shelf so that as the grasping means causes the base to rotate, the interior teeth ride on the threads and when the shaft is rotated in one direction the teeth rotate upwardly on the threads and cause the hollow shelf to move upwardly within the casing and when the grasping means is rotated in the opposite direction the teeth ride downwardly on threads and cause the hollow shelf to move downwardly within the casing.

12. The cosmetic applicator in accordance with claim 11 further comprising a cosmetic retained by the means to retain a cosmetic of the hollow shelf so that the cosmetic extends above the hollow cylindrical shelf within the internal cylindrical casing so that the cosmetic is exposed when the shaft is rotated in one direction to cause the interior teeth to move upwardly on the threads of the shaft and the cosmetic is retracted when the shaft is rotated in the opposite direction to cause the interior teeth to move downwardly on the threads of the shaft.

13. The cosmetic applicator in accordance with claim 11 further comprising a cover having a cylindrical wall and a top and an open bottom defining an interior cavity, the cover placed over the casing so that it rests within the internal cavity of the top cover when the cosmetic applicator is not in use.

14. The cosmetic applicator in accordance with claim 11 wherein the internal casing and its components, the shaft and its components, and the hollow shelf and its components are made of plastic.

* * * * *